US006817846B2

(12) United States Patent
Bennitt

(10) Patent No.: US 6,817,846 B2
(45) Date of Patent: Nov. 16, 2004

(54) GAS COMPRESSOR AND METHOD WITH IMPROVED VALVE ASSEMBLIES

(75) Inventor: Robert Bennitt, Painted Post, NY (US)

(73) Assignee: Dresser-Rand Company, Olean, NY (US)

( * ) Notice: Subject to any disclaimer, the term of this patent is extended or adjusted under 35 U.S.C. 154(b) by 45 days.

(21) Appl. No.: 10/171,163

(22) Filed: Jun. 13, 2002

(65) Prior Publication Data

US 2003/0231969 A1 Dec. 18, 2003

(51) Int. Cl.[7] ..... F04B 53/00

(52) U.S. Cl. ..... 417/523; 417/534; 417/552; 417/545; 137/512.1

(58) Field of Search ..... 417/523, 533, 417/534, 545, 546, 552, 553; 137/512.1

(56) References Cited

U.S. PATENT DOCUMENTS

| | | | | | |
|---|---|---|---|---|---|
| 87,828 | A | * | 3/1869 | Davis | 417/553 |
| 454,875 | A | * | 6/1891 | Mellin | 137/512.1 |
| 1,479,603 | A | | 1/1924 | Hiller | |
| 1,568,776 | A | | 1/1926 | Smith | |
| 1,602,193 | A | * | 10/1926 | Garber | 417/525 |
| 2,295,592 | A | * | 9/1942 | McConnohie | 417/515 |
| 3,238,889 | A | | 3/1966 | Huber et al. | |
| 4,221,548 | A | | 9/1980 | Child | |
| 5,011,383 | A | | 4/1991 | Bennitt | 417/534 |
| 5,015,158 | A | | 5/1991 | Bennitt | |
| 5,051,074 | A | | 9/1991 | Cowan | |
| 5,209,647 | A | | 5/1993 | Bennitt | |
| 5,236,008 | A | | 8/1993 | Bennitt | |
| 5,655,503 | A | | 8/1997 | Kampichler | |
| 5,658,134 | A | * | 8/1997 | Gagnon et al. | 417/534 |
| 5,727,930 | A | | 3/1998 | Bennitt et al. | 417/523 |
| 5,958,134 | A | | 9/1999 | Yasar et al. | |
| 6,382,940 | B1 | | 5/2002 | Blume | |
| 6,464,474 | B2 | | 10/2002 | Schluecker | |
| 2002/0144733 | A1 | * | 10/2002 | Artner | |
| 2003/0133813 | A1 | | 7/2003 | Bennitt et al. | |

* cited by examiner

*Primary Examiner*—Cheryl J. Tyler
(74) *Attorney, Agent, or Firm*—Michael Best & Friedrich LLP

(57) ABSTRACT

A gas compressor and method according to which a piston assembly reciprocates in a bore to draw the fluid to be compressed into the bore during movement of the piston unit in one direction and to compress the fluid during movement of the piston unit in the other direction.

5 Claims, 6 Drawing Sheets

GAS COMPRESSOR AND METHOD WITH IMPROVED VALVE ASSEMBLIES

BACKGROUND

This invention relates, in general, to a fluid compressor, and, more particularly, to a compressor having improved discharge valves.

Many reciprocating compressor cylinders utilize a piston assembly that reciprocates in a cylinder formed in the compressor body, with outer heads closing off the ends of the cylinder. In these arrangements, the piston assembly often includes a discharge valve that controls the gas flow through its body structure into the cylinder and then compresses the fluid before permitting the compressed fluid to discharge through the outlet.

These type of valve assemblies utilize a plate valve which "lifts" off a valve seat in response to a pressure differential created from one side of the valve to the other side, to permit flow through the assembly. However, this flow area through the valve assembly is often limited in size, which compromises the efficiency of the compressor.

Therefore, what is needed is a compressor of the above type according to which the valve assemblies have a relatively large flow area and the compressor thus has an increased efficiency.

DETAILED DESCRIPTION

Figure 1:
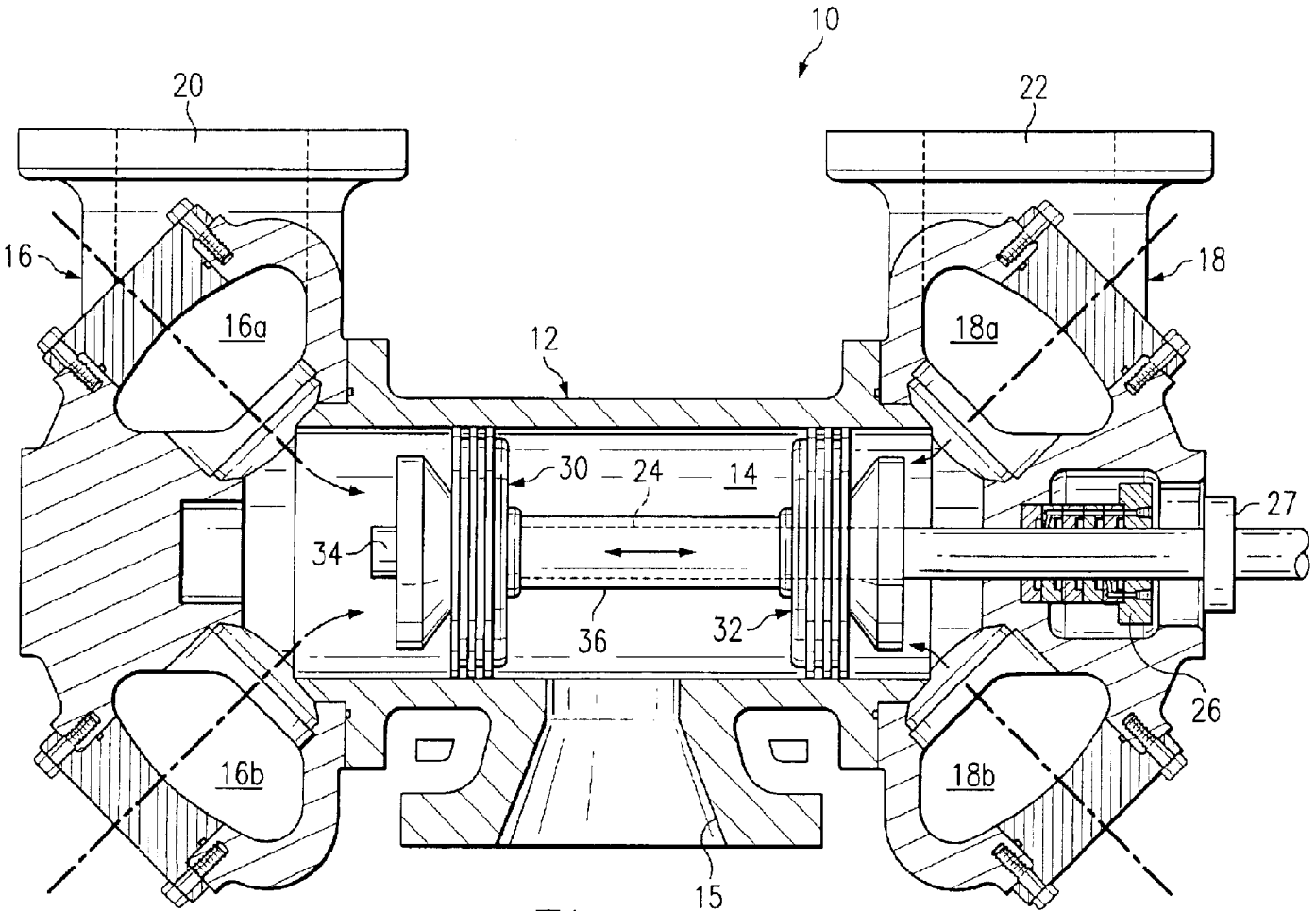
FIG. 1 is a partial sectional-partial elevational, view of a fluid compressor according to an embodiment of the present invention.

Referring to FIG. 1 of the drawings the reference numeral 10 refers, in general, to a compressor for compressing a fluid, such as gas, according to an embodiment of the present invention. The compressor 10 includes a cylindrical housing 12 defining an internal cylindrical bore 14 and a radially extending outlet 15 that registers with the bore 14.

An outer head 16 is formed at one end of the housing 12, and a frame head 18 is mounted at the other end of the housing. A plurality of inlet chambers are formed through the head 16 with two being shown in FIG. 1 and referred to by the reference numerals 16*a* and 16*b*. The inlet chambers 16*a* and 16*b*, as well as the other inlet chambers in the head 16, are interconnected and are in fluid communication with an inlet conduit 20 formed on the body member 12.

The head 18 is identical to the head 16 and, as such, has a plurality of inlet chambers formed therein, two of which are shown in FIG. 1 and referred to by the reference numerals 18*a* and 18*b*. The inlet chambers 18*a* and 18*b*, as well as the other inlet chambers in the head 18, are interconnected and are in fluid communication with an inlet conduit 22 formed on the body member 12.

The inlet conduits 20 and 22 are adapted to receive a fluid to be compressed, such as a gas, and direct the gas into the heads 16 and 18 for discharge into the bore 14 as shown by the arrows in FIG. 1.

A drive rod 24 extends through the center of the head 18 and into the bore 14, and is mounted for reciprocal movement in a packing gland assembly 26 mounted in a chamber formed in the head 18. The packing gland assembly 26 functions in a conventional manner to seal against compressed gas from leaking past the rod 24. An end portion of the rod 24 projects from the bore 14 and through a collar 27 mounted to the face of the head 18 and, although not shown in the drawings, it is understood that it is connected to a conventional prime mover for reciprocating the rod in a right-to-left and in a left-to-right direction as viewed in FIG. 1, as shown by the double-headed arrow.

Figure 2:
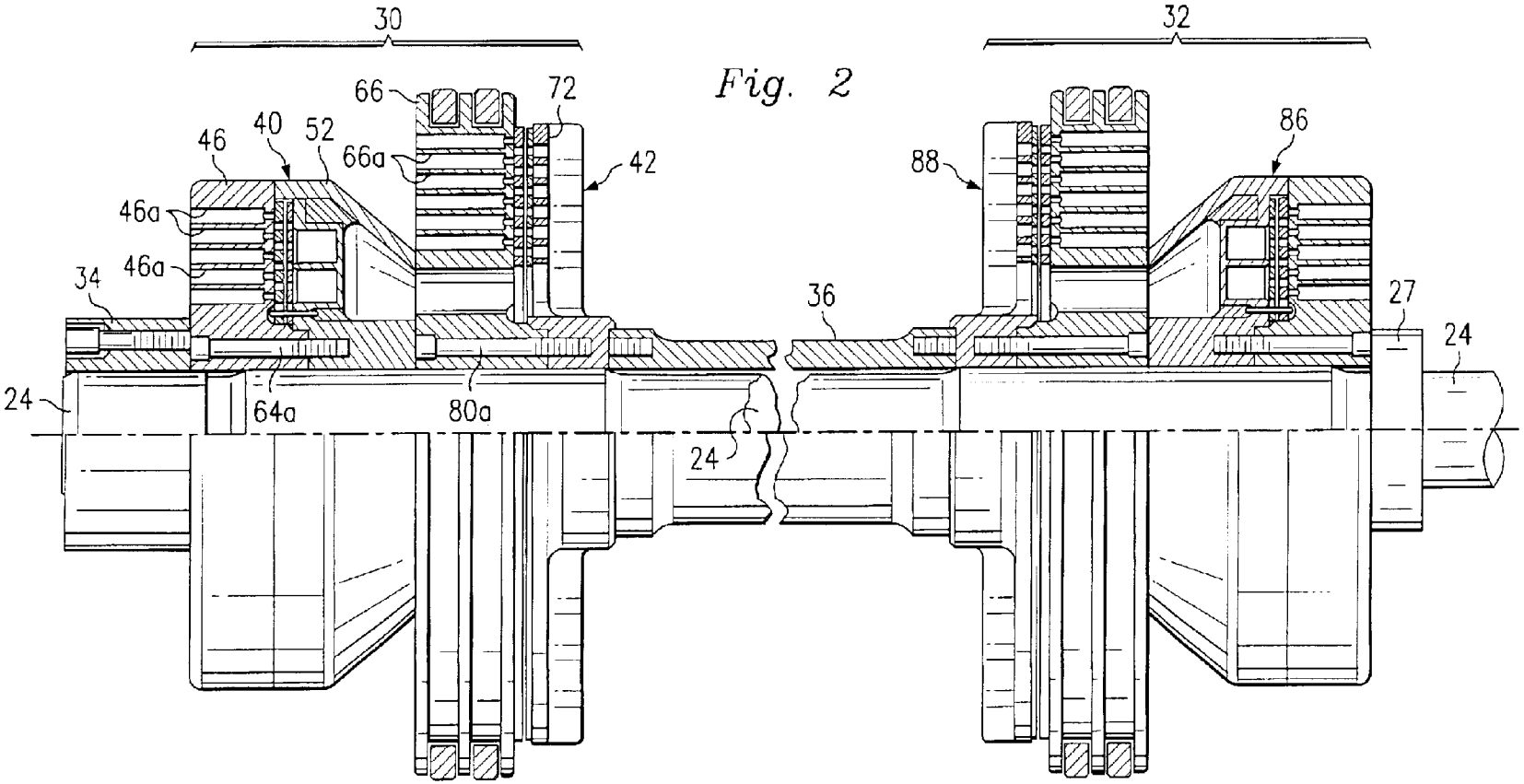
FIG. 2 is an enlarged sectional view of the piston assemblies of the compressor of FIG. 1.

An outboard piston assembly 30 and an inboard piston assembly 32 are disposed in the bore 14 in a spaced relation. The rod extends through central openings in the piston assemblies 30 and 32, and a jam nut 34 abuts the outboard face of the piston assembly 30 and is connected to the other end of the rod 24 in any conventional manner, such as by a plurality of bolts, or the like. A tubular spacer 36 extends between the piston assemblies 30 and 32 and is connected thereto in a manner to be described. Thus, when the above-mentioned reciprocal movement is imparted to the rod 24, the piston assemblies 30 and 32 reciprocate in the bore 14 with the rod 24, and function to draw the gas into the bore 14 and compress the gas before the gas is discharged through the outlet 15, in a manner to be described.

as shown in FIG. 2, the outboard piston assembly 30 consists of an outboard valve assembly 40 and an inboard valve assembly 42 disposed in an abutting relationship. The jam nut 34 abuts the outboard face of the outboard valve assembly 40, the inboard face of the outboard valve assembly abuts the outboard face of the inboard valve assembly 42, and the inboard face of the inboard valve assembly is connected to the spacer 36.

Figure 3:
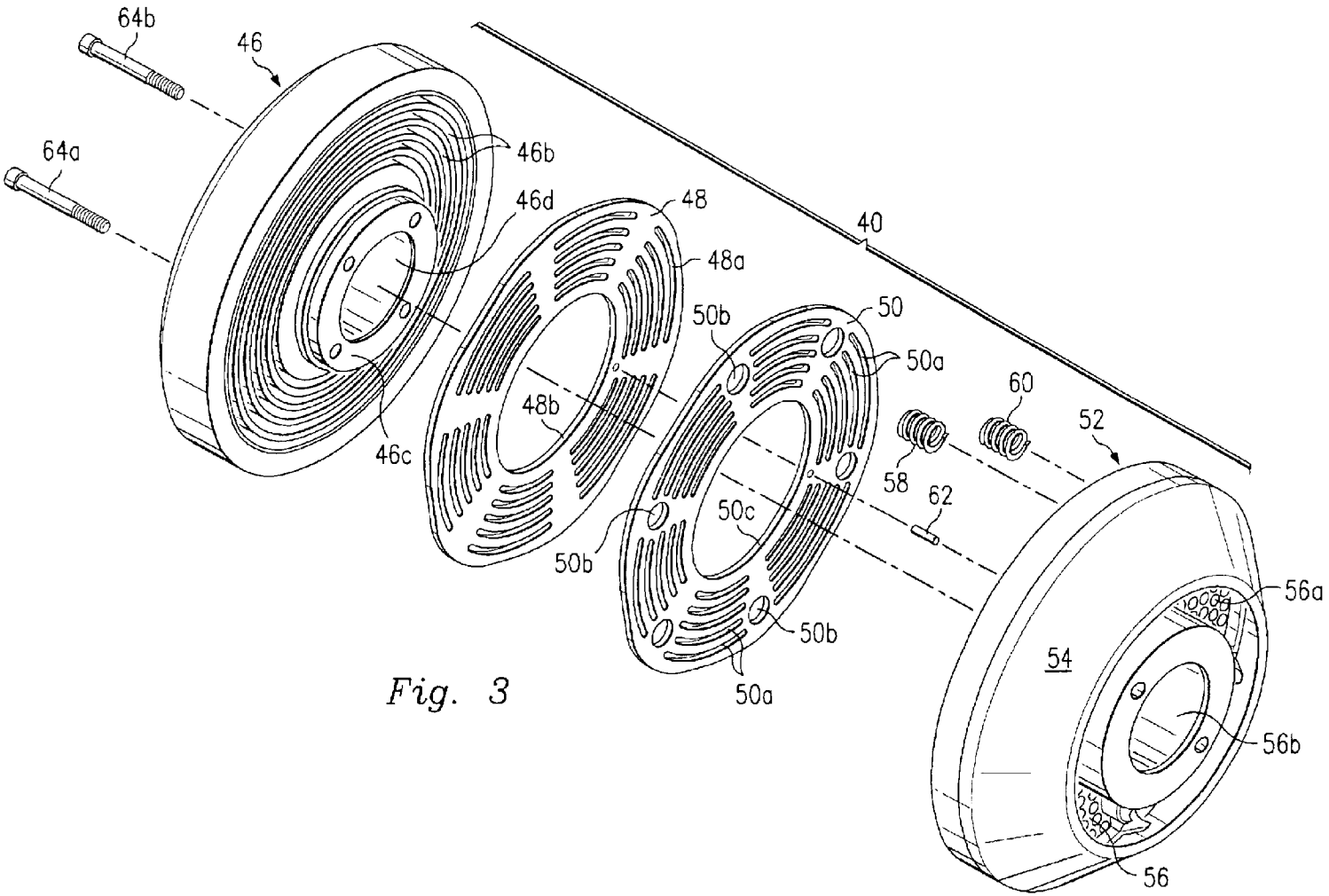
FIG. 3 is an exploded, isometric view of an outboard valve assembly utilized in a piston assembly of FIG. 2.

The outboard valve assembly 40 is shown in detail in FIGS. 2 and 3 and consists of an annular valve seat 46 having an outer diameter less that the diameter of the inner wall of the body member 12 defining the bore 14. A plurality of spaced bores 46*a* (FIG. 2) extend from the outboard face of the valve seat to a plurality of angularly and radially spaced, slots 46*b* (FIG. 3) formed in the inboard face of the seat. A reduced-diameter, annular stop 46*c* extends from the inboard face of the seat 46 and a relatively large central opening 46*d* is formed through the seat 46 for receiving the rod 24 (FIG. 2).

An annular valve plate 48, having a diameter slightly less than the diameter of the valve seat 46, is provided and has a plurality of angularly and radially spaced, arcuate slots 48*a* formed therethrough. A relatively large central opening 48*b* is formed through the valve plate 48 for receiving the rod 24 (FIG. 2). The valve plate 48 is adapted to move axially in the bore 14 relative to the valve seat 46 between a first position in which it engages the inboard face of the valve seat 46 and a second position in which it is spaced from the seat. In the first position, the non-slotted portion of the valve plate 48 blocks the slots 46*b* of the valve seat 46 to prevent gas flow through the valve seat, and in the second position gas can flow through the slots 46*b* and through the slots 48*a* of the valve plate.

An annular dampening plate 50 is disposed adjacent the valve plate 48, is approximately the same diameter as the valve plate, and functions to decelerate movement of the valve plate under conditions to be described to prevent damage caused by impact inertia. To this end, the mass of the dampening plate 50 is normally greater than that of the valve plate 48 so that the plate 50 dampens movement of the plate 48 under conditions to be described. A plurality of angularly and radially spaced, arcuate slots 50*a* extend through the plate 50 and are in alignment with the slots 48*a* of the plate 48. Six angularly-spaced through openings 50*b* are also provided in the plate 50 for reasons to be described, and a relatively large central opening 50*c* is formed through the plate 50 for receiving the rod 24 (FIG. 2).

A valve guard 52 is disposed adjacent the dampening plate 50 and functions to provide a positive stopping point for the dampening plate 50, also under conditions to be described. The valve guard 52 consists of a housing 54 having a tapered, or funnel-shaped, cross-section. A plate 56 is disposed in the housing 54 and has a plurality of through openings 56*a* and a relatively large central through opening 56*b* for receiving the rod 24. As shown in FIG. 2, the outboard end portion of the housing 54 envelopes the outer circumferential portions of the valve plate 48 and the dampening plate 50.

One end portion of a spring 58 extends into a pocket, or the like, (not shown) formed in the outboard face of the valve guard 52. The spring 58 extends through an opening 50*b* in the dampening plate 50 and its other end engages the inboard face of the valve plate 48. Although only one spring 58 is shown, it is understood that five other springs are provided which are identical to the spring 58 and which extend through the remaining five openings 50*b* in the plate 50, respectively. The springs 58 function to urge the valve plate 48 into engagement with the valve seat 46 until forced away from the seat by differential fluid pressure, as will be described.

One end of a spring 60 also extends into a pocket, or the like, (not shown) formed in the outboard face of the valve guard 52 and its other end engages the inboard face of the dampening plate 50. The spring 60 functions to urge the dampening plate 50 into engagement with the stop 46*c* and in a slightly spaced relation to the valve plate 48 until forced away from the stop by differential fluid pressure. Although only one spring 60 is shown in the drawing, it is understood that additional springs can be provided that are identical to the spring 60 and function in the same manner.

The springs 58 and 60 normally bias the valve plate 48 into a sealing position against the valve seat 46, and the dampening plate 50 against the stop 46*c*, respectively.

An alignment pin 62 extends though corresponding aligned openings in the valve plate 48 and the dampening plate 50 for maintaining proper angular alignment of the plates. Two cap screws 64*a* and 64*b* extend through aligned openings in the valve seat 46, through the center openings 48*b* and 50*c* in the plates 48 and 50, respectively, and engage threaded bores in the valve guard 52 to maintain the valve assembly 40 in its assembled condition shown in FIG. 2.

Figure 4:
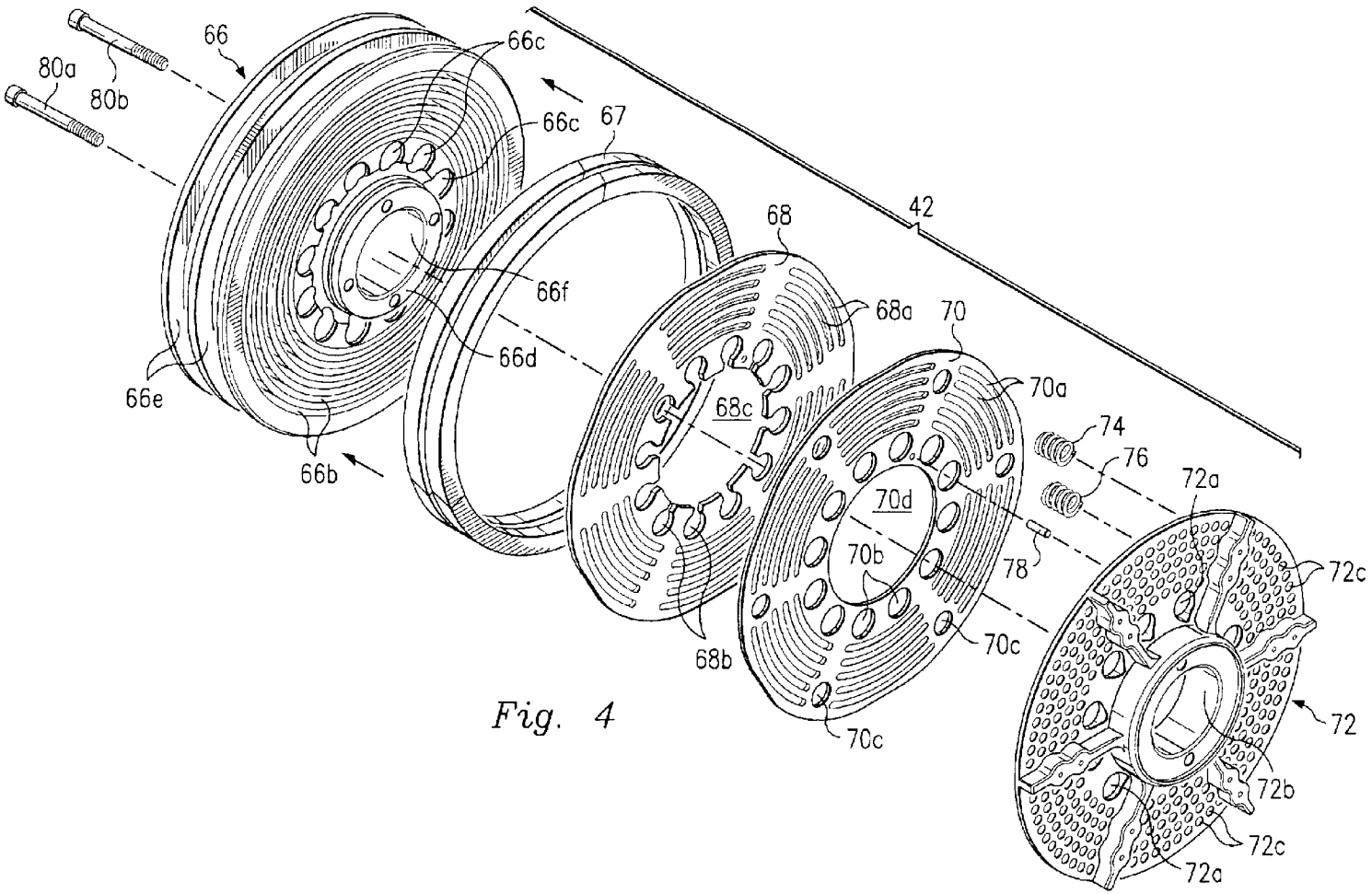
FIG. 4 is an exploded, isometric view of an inboard valve assembly utilized in the piston assembly of FIG. 2.

The inboard valve assembly 42 is shown in detail in FIGS. 2 and 4 and consists of an annular valve seat 66 having an outer diameter slightly less that the diameter of the inner wall of the body member 12 (FIG. 1) defining the bore 14. A plurality of spaced bores 66*a* (FIG. 2) extend from the outboard face of the valve seat 66 to a plurality of radially spaced, slots 66*b* (FIG. 3) formed in the inboard face of the seat. A plurality of angularly-spaced portals 66*c* are formed though the seat 66, and a reduced-diameter annular stop 66*d* projects from the inboard face of the valve seat 66.

A plurality of circumferential grooves 66*e* are formed in the outer surface of seat 66 and receive a corresponding number of seal rings 67 which engage the inner wall of the body member defining the bore 14, to seal against the flow of compressed gas from the bore. A relatively large central opening 66*f* is formed through the seat 46 for receiving the rod 24 (FIG. 2).

An annular valve plate 68, is provided and has a plurality of angularly and radially spaced, arcuate slots 68*a* extending therethrough. The valve plate 68 is adapted to move in the bore 14 between a first position in which it engages the inboard face of the valve seat 66, with the non-slotted portion of the plate blocking the slots 66*b* of the valve seat, and a second position in which it is spaced from the seat to permit the flow of gas through the slots in the valve seat and the slots 68*a* of the valve plate. A plurality of angularly-spaced portals 68*b* are formed though the plate 68, and a relatively large central opening 68*c* is formed through the plate 68 for receiving the rod 24 (FIG. 2).

An annular dampening plate 70 is disposed adjacent the valve plate 68 and functions to decelerate the valve plate under conditions to be described to prevent damage caused by impact inertia. To this end, the mass of the dampening plate 70 is greater than that of the valve plate 68 so that the plate 70 dampens movement of the plate 68. A plurality of angularly and radially spaced, arcuate slots 70*a*, and a plurality of angularly spaced portals 70*b* extend through the plate 70. The slots 70*a* register with the slots 68*a* of the valve plate 68, and the portals 70*b* register with the portals 68*b* of the valve plate 68. Six angularly-spaced openings 70*c* are provided through the plate 70 for reasons to be described, and a relatively large central opening 70*d* is formed through the plate 70 for receiving the rod 24 (FIG. 2).

An annular guard plate 72 is disposed adjacent the dampening plate 70 and functions to provide a positive stopping point for the dampening plate 70, also under conditions to be described. A plurality of angularly-spaced portals 72*a* extend through the guard plate 72 and register with the portals 70*b* of the dampening plate 70, and a relatively large central opening 72*b* is formed through the guard plate 72 for receiving the rod 24(FIG. 2). The plate 72 also has a plurality of relatively small through openings 72*c*, for reasons to be described.

One end portion of a spring 74 extends into a pocket, or the like, (not shown) formed in the outboard face of the guard plate 72. The spring 74 extends through an opening 70*c* in the dampening plate 70 and its other end engages the inboard face of the valve plate 68. Although only one spring 74 is shown, it is understood that five other springs are provided which are identical to the spring 74 and which extend through the remaining five openings 70*c*, respectively. The springs 74 function to urge the valve plate 68 into engagement with the valve seat 66 until forced away from the seat by differential fluid pressure under conditions to be described.

One end of a spring 76 also extends into a pocket, or the like, (not shown) formed in the outboard face of the valve guard 72 and its other end engages the inboard face of the dampening plate 70 to urge the dampening plate into engagement with the stop 66*d* until forced away by differential fluid pressure. Although only one spring 76 is shown in the drawing, it is understood that additional springs can be provided that are identical to the springs 74 and 76 and function in the same manner.

An alignment pin 78 extends though corresponding aligned openings in the dampening plate 70 and the valve plate 68 for maintaining proper angular alignment of the plates. Two cap screws 80*a* and 80*b* extend through aligned openings in the valve seat 66, through the center openings in the plates 68 and 70, though the valve guard 72 and engage threaded bores in the spacer 24 (FIG. 2) to maintain the valve assembly 42 in its assembled condition shown in FIG. 2.

As shown in FIG. 2, the outer diameter of the valve assembly 40 is considerably less than the outer diameter of the valve assembly 42 and the corresponding inner wall of the body member 12 defining the bore 14. Thus, some of the gas from the head 16 passes around the outer surfaces of the valve assembly 40 and directly to the valve assembly 42 under conditions to be described.

The general operation of the valve assemblies 40 and 42 is as follows. When gas is admitted into the head 16 from the inlet conduit 20, the gas passes through the inlet chambers in the head, including the chambers 16*a* and 16*b*, and into the outboard end portion of the bore 14. As better shown in FIG. 1, a portion of this gas passes around the outer surface of the valve assembly 40 of the piston assembly 30 and to the valve assembly 42 which controls the flow of the gas in a manner to be described.

As better shown in FIGS. 2 and 3, the remaining portion of the gas passes through the bores 46*a* and the slots 46*b* in the valve seat 46 and exerts a pressure against the outboard face of the valve plate 48. When this pressure exceeds the pressure acting on the inboard face of the valve seat 46 by the springs 58, the valve plate 48 will be forced off the seating surface of the valve seat 46 and will move in a left-to-right direction as viewed in FIG. 2 until it encounters the dampening plate 50, and both plates then travel a short distance in unison until they come in contact with the plate 56 of the valve guard 52.

This allows the passage of compressed gas through the openings 46*a* and the slots 46*b* in the valve seat 48, and through the aligned slots 48*a* and 50*a* in the valve plate 48 and the dampening plate 50, respectively, before passing through the openings 56*a* in the plate 56. The tapered housing 54 of the valve guard functions to funnel, or direct the gas passing through the openings 56*a* towards the center, or axis of the valve assembly 42 so that the gas passes through the aligned portals 66*c*, 68*b*, 70*b*, and 72*a* (FIG. 4) of the valve seat 66, the valve plate 68, the dampening plate 70, and the guard plate 72, respectively, before the gas enters that portion of the bore 14 disposed between the piston assemblies 30 and 32 as shown in FIG. 1.

The above-mentioned gas from the head 16 that passed around the outer surface of the valve assembly 40 of the piston assembly 30 passes directly to the valve assembly 42. As better shown in FIGS. 2 and 4, this latter gas then passes through the bores 66*a* and the slots 66*b* in the valve seat 66 and exerts a pressure against the outboard face of the valve plate 68. When this pressure exceeds the pressure acting on the inboard face of the valve seat 66 by the springs 74, the valve plate 68 will be forced off the seating surface of the valve seat 66 and moved in a left-to-right direction, as viewed in FIG. 2. This allows passage of compressed gas through the valve seat 66 and through the aligned slots in the valve plate 68, the dampening plate 70 and the valve guard 72 before the gas enters the portion of the bore 14 extending between the piston assemblies 30 and 32. Thus, this portion of the bore 14 receives two streams of gas from the piston assembly 30, one that flows through both valve assemblies 40 and 42, and one that flows only through the valve assembly 42.

During the above operation, and as a non-limitative example, the valve plates 48 and 68 will move, or "lift", for approximately 0.060" until they come into contact with their corresponding dampening plates 50 and 70, respectively. The plates 48 and 50, as well as the plates 68 and 70, will then move together approximately another 0.020" while they decelerate and then come into contact with their respective valve guards 52 and 72.

Referring to FIG. 2, the piston assembly 32 consists of two abutting valve assemblies 86 and 88 that are identical to the valve assemblies 40 and 42, respectively, of the piston assembly 30. The valve assemblies 86 and 88 face in the opposite direction than the valve assemblies 40 and 42 and the valve assembly 86 is positioned inboard of the valve assembly 88. The valve assemblies 86 function in a manner identical to the functions of the valve assemblies 40 and 42, respectively. Thus, some of the fluid introduced into the bore 14 from the inlet chambers formed in the head 18, including the inlet chambers 18*a* and 18*b*, will pass into end portion of the bore 14 inboard of the valve assembly 86. When the rod 24, and therefore the valve assemblies 30 and 32, move in a left-to-right direction, the pressure of the latter gas will exert a pressure on the valve plate associated with the valve assembly 86 to force it to move in a right-to-left position from its sealing position before the gas passes through the valve assembly 88 and into that portion of the bore between the piston assemblies 30 and 32.

The remaining portion of the gas from the head 18 will pass around the outer surfaces of the valve assembly 86 and directly to the valve assembly 88. This latter gas will exert a pressure on the valve plate associated with the valve assembly 88 to force it to move in a right-to-left position from its sealing position before the gas passes through the valve assembly 88 and into the latter portion of the bore 14. Thus, the bore 14 also receives two streams of gas from the piston assembly 32, one that flows through both valve assemblies 86 and 88, and one that flows only through the valve assembly 88.

The complete operation of the compressor 10 will be described in connection with FIGS. 5A–5H. As shown in FIG. 5A, the piston assemblies 30 and 32 divide the bore 14 into a section 14*a* between the head 16 and the piston assembly 30, a section 14*b* between the piston assemblies 30 and 32, and a section 14*c* between the piston assembly 32 and the head 18. For the purposes of example, it will be assumed that as a result of a previous cycle of operation, a fluid, such as gas, or other product, has been drawn into the bore section 14*a*, and the rod 24, and therefore the piston assemblies 30 and 32, are in their extreme right position, as viewed in FIG. 5*a* as a result of a previous cycle of the operation.

The gas is introduced, via the inlet conduit 22, into the inlet chambers, including the chambers 18*a* and 18*b*, formed in the head 18. The rod 24, and therefore the piston assemblies 30 and 32, are moved in a right-to-left direction, as shown by the solid arrow, from the position of FIG. 5A to the position of FIG. 5B, under the power of the above-mentioned prime mover. This movement draws gas from the head 18 into the bore section 14*c* and causes the gas that is present in the bore section 14*a* from the previous cycle to be compressed.

Figure 5C:
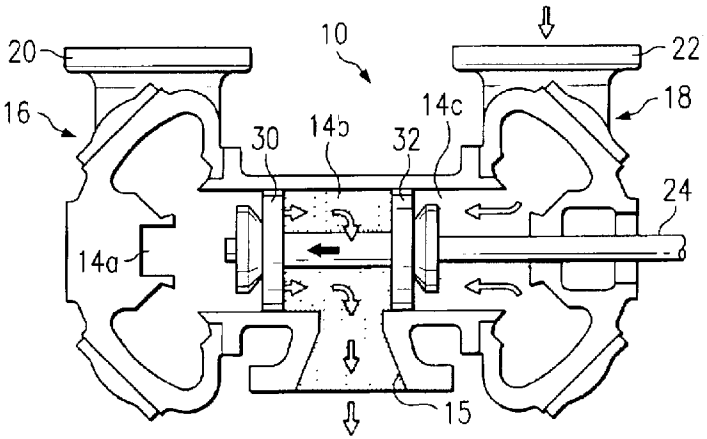
FIGS. 5*a*–5*h* are diagrammatic views depicting the operation of the compressor of FIG. 1.
Figure 5D:
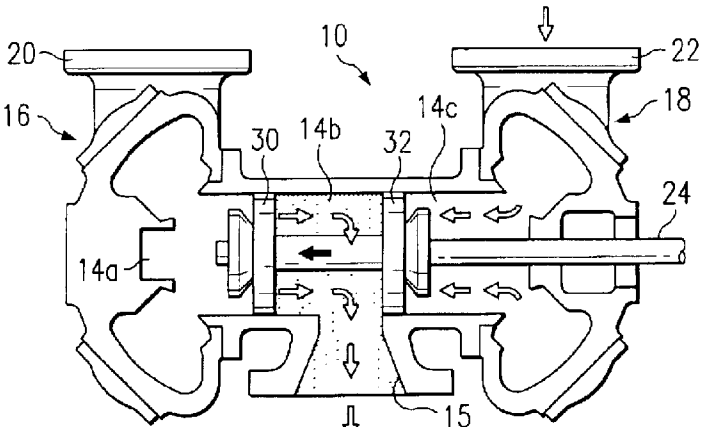
Figure 5A:
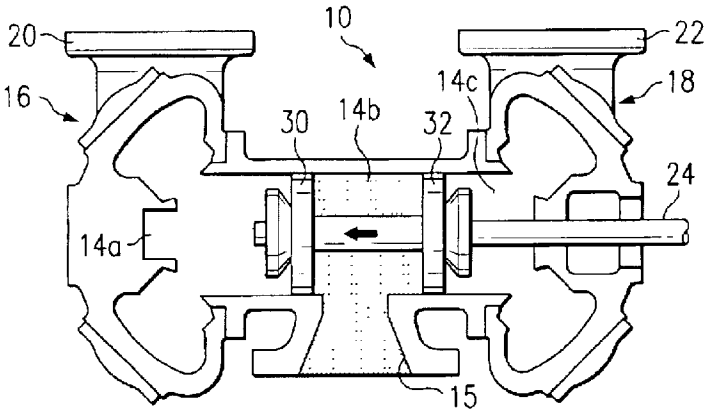
Figure 5B:
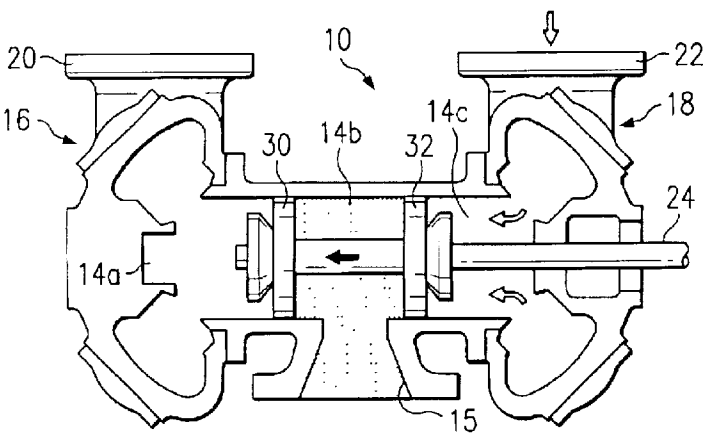

Further right-to-left movement of the rod 24, and therefore the piston assemblies 30 and 32, to the position of FIG. 5C causes additional gas to be drawn in the bore section 14*c* in the manner discussed above, and further increases the fluid pressure in the bore section 14*a*. Some of this compressed gas flows into the valve assembly 40 of the piston assembly 30 in the manner described above, and the right-to-left movement of the rod 24 continues until the pressure in the bore section 14*a* is great enough to move the valve plate 48 of the valve assembly 40 in a left-to-right direction off of its valve seat 46. The above portion of the compressed gas thus flows through the valve assembly 40 in the manner described above and to the valve assembly 42 where it passes through the aligned openings 66*c*, 68*b*, 70*b*, and 72*a* (FIG. 4) of the latter assembly and to the bore section 14*b*, as shown by the hollow arrows in FIG. 5C. Thus, in this case the valving function of the valve seat 66 and the plate 68 are bypassed.

The other portion of the compressed gas in the bore section 14*a* passes around the valve assembly 40 and directly into the valve assembly 42 as also described above. When the gas pressure in the bore section 14*a* is great enough to move the valve plate 68 of the valve assembly 42 in a left-to-right direction off of its valve seat 46, the latter portion of the compressed gas thus flows through the valve assembly 42 in the manner described above and into the bore section 14*c*.

The compressed gas that flows into the bore section 14*b* in the two manners described above exits the body member 12 through the outlet 15 and is transferred from the compressor 10 via a pipe, or the like, connected to the outlet.

This right-to-left movement of the rod 24 and the piston assemblies 30 and 32 continues, causing further compression of the gas in the bore section 14*a* and passage of the compressed gas though the valve assemblies 40 and 42 of the piston assembly 30. The gas in the bore section 14*a* discharges through the outlet 15 as described above until the rod 24 and the piston assemblies 30 and 32 reach the end position shown in FIG. 5D.

Figure 5G:
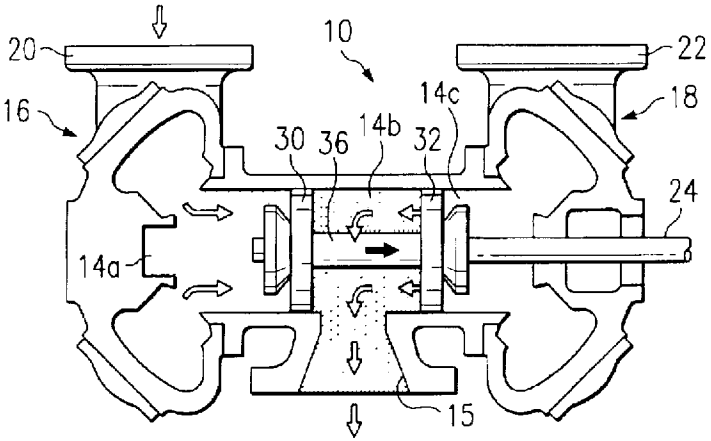
Figure 5H:
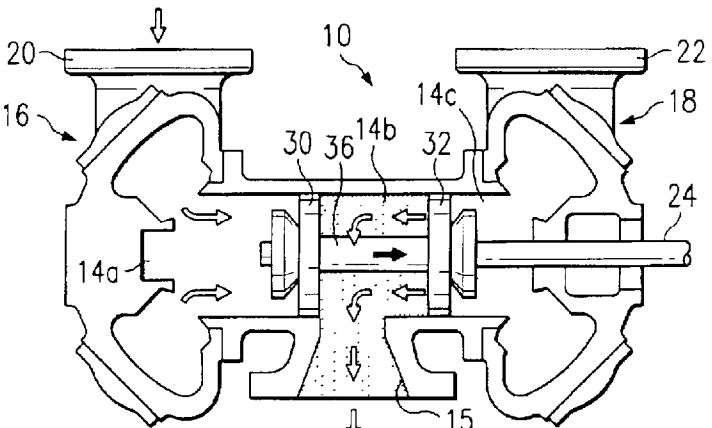
Figure 5E:
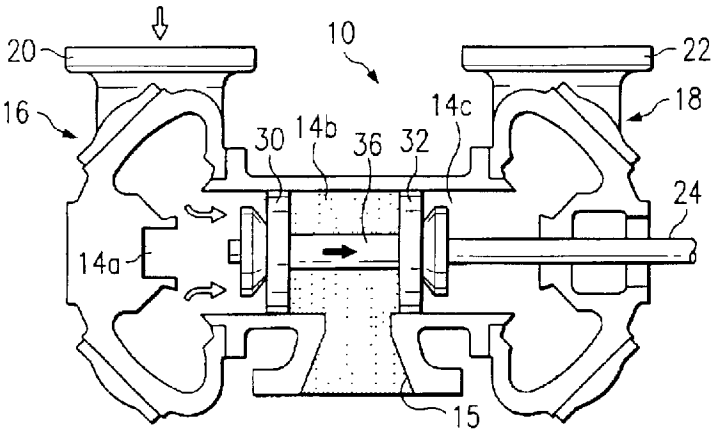
Figure 5F:
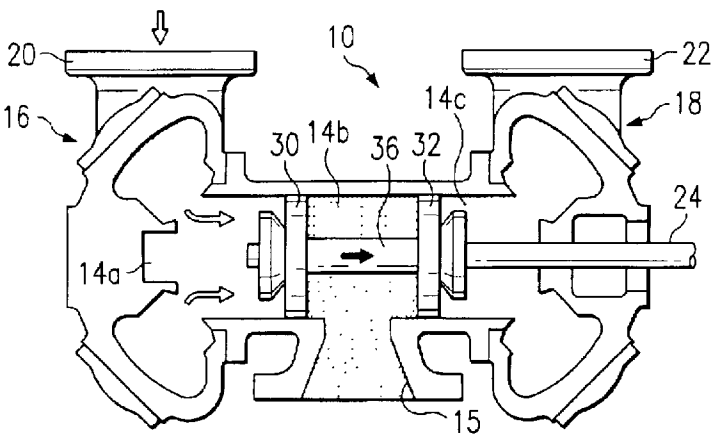

Referring to FIG. 5E, gas is introduced, via the inlet conduit 20 into the inlet chambers, including the chambers 16*a* and 16*b*, formed in the head 16. The rod 24, and therefore the piston assemblies 30 and 32, are moved in a left-to-right direction, as shown by the solid arrow, from the position of FIG. 5E to the position of FIG. 5F, under the power of the above-mentioned prime mover. This movement draws gas from the head 16 into the bore section 14*a* and causes the gas that is present in the bore section 14*c* as a result of the above operation to be compressed.

Further left-to-right movement of the rod 24, and therefore the piston assemblies 30 and 32, to the position of FIG. 5G causes additional gas to be drawn in the bore section 14*a* in the manner discussed above, and further increases the fluid pressure in the bore section 14*c*. Some of this compressed gas flows into the valve assembly 86 of the piston assembly 30 in the manner described above, and the left-to-right movement of the rod 24 continues until the pressure in the bore section 14*c* is great enough to move the valve plate of the valve assembly 86 in a right-to-left direction off of its valve seat. The above portion of the compressed gas thus flows through the valve assembly 86 in the manner described above and to the valve assembly 88 where it passes through the aligned openings of the latter assembly and to the bore section 14*b*, as shown by the hollow arrows in FIG. 5G.

The other portion of the compressed gas in the bore section 14*c* passes by the valve assembly 86 and directly into the valve assembly 88 as also described above. When the gas pressure in the bore section 14*c* is great enough to move the valve plate of the valve assembly 88 in a right-to-left direction off of its valve seat 46, the latter portion of the compressed gas thus flows through the valve assembly 88 in the manner described above.

The compressed gas that flows into the bore section 14*b* in the two manners described above exits the body member 12 through the outlet 15 and is transferred from the compressor 10 via a pipe, or the like, connected to the outlet.

This right-to-left movement of the rod 24, and the piston assemblies 30 and 32, continues, causing further compression of the gas in the bore section 14*c* and passage of the compressed gas though the piston assembly 32 and discharge of the gas through the outlet 15 as described above until the rod 24 and the piston assemblies reach the end position shown in FIG. 5H.

The above cycle is then repeated and the compressor 10 thus functions to continuously receive gas via the inlet conduits 20 and 22 and discharge compressed gas from the outlet 15.

Alternatives and Equivalents

It is understood that some of the components of the compressor 10 have been omitted in the interest of clarity. For example, although a dual acting system having two piston assemblies is disclosed above, it is understood that the present invention is equally applicable to a single acting system assembly in which only one piston assembly would be provided which would function in an identical manner to the piston assemblies 30 and 32. Further, the present invention is not limited to the particular design of the valve assemblies 40, 42, 86 and 88 disclosed above, but rather other types of valve assemblies can be used, such as, for example, those disclosed in U.S. Pat. No. 5,011,383 or No. 5,015,158 (the disclosures of which are incorporated by reference) or those employing a series of rings or bullets. Still further, a plurality of inlet valves can be disposed in the inlet chambers defined in the heads 16 and 18 as disclosed in co-pending U.S. application Ser. No. 10/047,385 the disclosure of which is incorporated by reference. Moreover, another fluid, other than gas, can be compressed by the compressor 10. Moreover, the number of openings extending through the valve seat 66, the plates 68 and 70, and the valve guard 72 can be varied; and the number of springs 58, 60, 74, and 76 utilized in the above manner can be varied depending on the particular load conditions.

Those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A fluid compressor comprising:

a body member defining an internal bore having an inlet at one end and an outlet;

a first valve assembly disposed in the bore between the one end of the bore and the outlet;

a second valve assembly disposed in the bore between the one end of the bore and the outlet in an axially spaced relation to the first valve assembly;

the first and second valve assemblies being movable in a first direction in the bore to draw fluid through the inlet and into the bore;

the first and second valve assemblies being adapted to move in a second direction in the bore to increase the fluid pressure in the bore;

the first valve assembly being responsive to a predetermined fluid pressure acting on it for permitting the flow of a first portion of the fluid in the bore through the first valve assembly and to the second valve assembly;

the second valve assembly defining a bypass passage for receiving the first portion of fluid from the first valve assembly and passing the first fluid portion to the outlet and defining at least one other passage through the second valve assembly; and the second valve assembly being responsive to a second portion of fluid in the bore exerting a predetermined fluid pressure on the second valve assembly for permitting the flow of the the second fluid portion through the at least one other passage and to the outlet.

2. The compressor of claim 1 wherein another inlet is disposed in the body member for introducing additional fluid into the other end of the bore, and further comprising a third valve assembly disposed in the bore in an axially spaced relation to the second valve assembly, a fourth valve assembly disposed in the bore in an axially spaced relation to the third valve assembly, means for moving the first, second, third and fourth valve assemblies in the first and second directions, whereby movement of the valve assemblies in the second direction draws the additional fluid from the other inlet into the other end portion of the bore so that a first portion of the additional fluid is directed to the fourth valve assembly and a second portion of the additional fluid is directed to the third valve assembly, wherein movement of the valve assemblies in the first direction increases the fluid pressure in the other end portion of the bore, the fourth valve assembly being responsive to a predetermined fluid pressure acting on it for permitting the flow of the first portion of the additional fluid through it and to the third valve assembly, and the third valve assembly defining a bypass passage for receiving the first portion of the additional fluid from the fourth valve assembly and passing it to the bore for passage to the outlet, the third valve assembly being responsive to the other portion of fluid exerting a predetermined fluid pressure on it for permitting the flow of fluid through it and to the bore for passage to the outlet.

3. The compressor of claim 2 wherein the second direction is opposite to the first direction.

4. The compressor of claim 2 wherein the means comprises a rod mounted for reciprocal movement in the bore and wherein the valve assemblies are attached to the rod for reciprocation therewith.

5. A method for compressing a fluid, comprising providing a bore having an inlet at one end and an outlet, disposing two valve assemblies in the bore between the one end of the bore and the outlet, moving the valve assemblies in the bore in a first direction to draw fluid through the inlet and into the bore, moving the valve assemblies in the bore in a second direction to increase the pressure in the bore, permitting the flow of a first portion of the fluid through the one valve assembly and to the other valve assembly in response to a predetermined fluid pressure acting on the one valve assembly, the first portion of the fluid bypassing the other valve assembly and passing to the outlet, and permitting the flow of another portion of the fluid through the other valve assembly and to the outlet in response to a predetermined fluid pressure acting on the other valve assembly.

* * * * *